US005404912A

United States Patent [19]

Hausler et al.

[11] Patent Number: 5,404,912

[45] Date of Patent: Apr. 11, 1995

[54] TRANSITION SPOOL FOR PNEUMATIC VALVE

[75] Inventors: Rick Hausler; Anthony Roshko, both of Bryan, Ohio

[73] Assignee: The Aro Corporation, Bryan, Ohio

[21] Appl. No.: 293,404

[22] Filed: Aug. 22, 1994

Related U.S. Application Data

[63] Continuation of Ser. No. 159,754, Nov. 30, 1993, abandoned, which is a continuation of Ser. No. 162, Jan. 4, 1993, abandoned.

[51] Int. Cl.[6] ..... F15B 13/043

[52] U.S. Cl. ..... 137/625.64; 137/884

[58] Field of Search ..... 137/625.64, 884, 625.66

[56] References Cited

U.S. PATENT DOCUMENTS

| | | | |
|---|---|---|---|
| 3,458,769 | 7/1969 | Stampfli | 137/625.64 X |
| 4,527,592 | 7/1985 | Dotti et al. | 137/625.64 X |
| 5,048,569 | 9/1991 | Stoll et al. | 137/625.64 |

FOREIGN PATENT DOCUMENTS

| | | | |
|---|---|---|---|
| 1100189 | 9/1955 | France | 137/625.61 |
| 2103390 | 2/1983 | United Kingdom | 137/625.64 |

*Primary Examiner*—Gerald A. Michalsky
*Attorney, Agent, or Firm*—Walter C. Vliet

[57] ABSTRACT

Disclosed is a means for conveying air required for pneumatic malfunction around an electrical connection, in particular where space is restricted to meet International standards. The invention is shown to provide manufacturing and assembly access while minimizing the occupied cross sectional area of the available passageway space in a stacked pneumatic valve.

4 Claims, 3 Drawing Sheets

TRANSITION SPOOL FOR PNEUMATIC VALVE

This application is a continuation of application Ser. No. 08/159,754, filed Nov. 30, 1993, now abandoned which is a continuation of application Ser. No. 08/000,162, filed on Jan. 04, 1993, now abandoned.

BACKGROUND OF THE INVENTION

This invention relates generally to pneumatic valves and more particularly to electrically operated pneumatic valves conforming to ISO Standard 5599-2 for pneumatic fluid power directional control valves having optional electrical connectors. Providing a true ISO type I valve with electrical connections that would not violate the envelope size inherent with this size valve while providing required valve shift response time and ease of manufacture has been difficult to develop in compliance with the standard utilizing standard connectors with the given envelope size.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully described hereinafter.

SUMMARY OF THE INVENTION

In one aspect of the present invention this is accomplished by providing a means for conveying pressure fluid through a bored space in a pressure fluid device while minimizing interruption of the space comprising an access bore of convenient diameter; a spool means for insertion in the bore from the bored end; the spool means being provided with sealing means at each end of the spool for sealing cooperation with the access bore; the spool means being further provided with an end to end through bore of selected minimum diameter to convey the pressure fluid; and the spool means being further provided with a wind area diameter less than said access bore diameter, but greater than the selected minimum diameter thereby forming a pressure fluid conduit of minimum diameter through the access bore.

The foregoing and other aspects will become apparent from the following detailed description of the invention when considered in conjunction with the accompanying drawing figures.

BRIEF DESCRIPTION OF THE DRAWING FIGURES

FIG. 5 is an end view of the spool valve according to the present invention showing the end access for a solenoid operator or the like;

DETAILED DESCRIPTION

Figure 1:
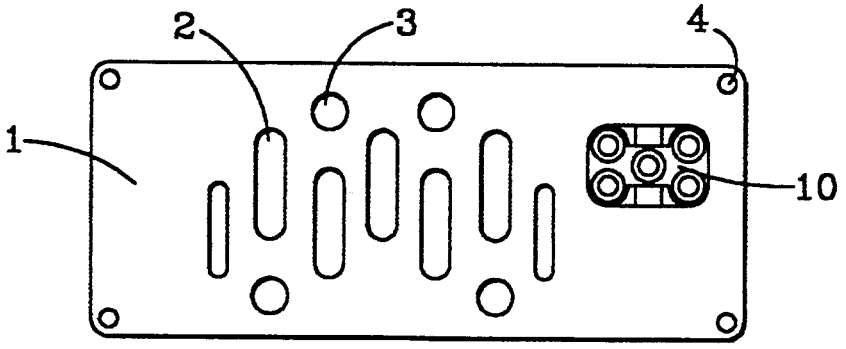
FIG. 1 is a plan view of an ISO type I valve with an electrical connection in the form of an ISO plug.

As shown in FIG. 1, an ISO type I sandwich pneumatic valve 1 is shown having an electrical connector in the form of an ISO plug 10. As can be seen in FIG. 1, a standard ISO plug occupies a considerable portion of the available cross sectional area of the valve. This can also be seen in FIG. 2 in relationship to the passageway structure.

The design incorporates integrated air passages or ports 2, stack bolt passages 3, and is provided with assembly orientation pins 4, as are well-known in the industry.

Figure 2:
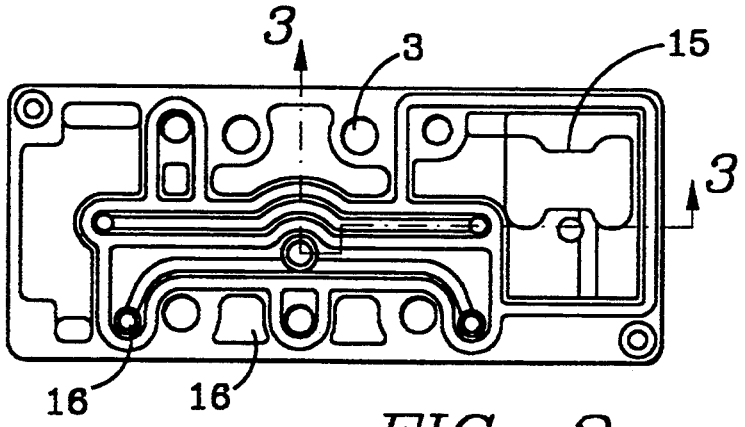
FIG. 2 is a plan section taken through the valve showing internal passageways.

Referring to FIG. 2, the internal valve construction requires a series of internal passageways, some of which are indicated by reference numeral 16. These passageways interconnect the various ports conducting pneumatic pressure fluid through the valve as controlled by a spool valve element (not shown).

Figure 6:
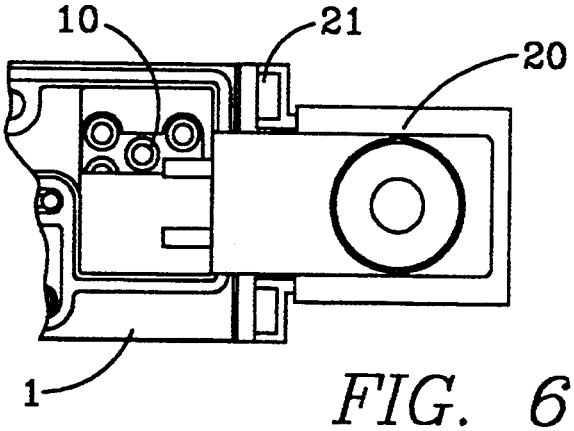
FIG. 6 is a partial plan view showing the orientation of the valve body and the solenoid valve in plan view.
Figure 7:
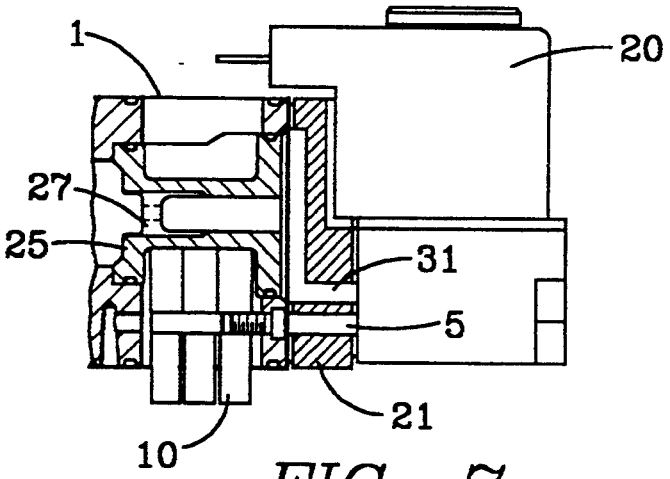
FIG. 7 is a side elevation and partial section showing the solenoid assembly in relationship to the valve and the transition spool according to the present invention.

Shifting of the spool valve element to accomplish selected function of the valve may be accomplished by pneumatically pressurizing one side of the spool or the other to effect its shift. The selected pressurization may further be accomplished by a solenoid operated valve assembly 20, best seen on FIGS. 6 and 7. One convenient location for such a solenoid operated valve is to the side of the pneumatic valve body, as shown in FIGS. 6 and 7. This is accomplished by means of installing a distribution end cap 21 on the side of the valve body 1 by means of mounting bolts installed through the solenoid assembly and end cap to threaded bolt holes 7 in the side of the valve body, best seen in FIG. 5. The side of the valve may also be provided with side assembly pins 6 and a cross port 5 which functions to supply pneumatic pressure fluid to the solenoid assembly.

Figure 3:
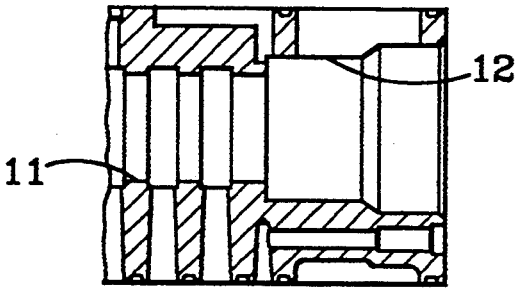
FIG. 3 is a partial cross section showing an elevation view of a spool bore in the valve.
Figure 4:
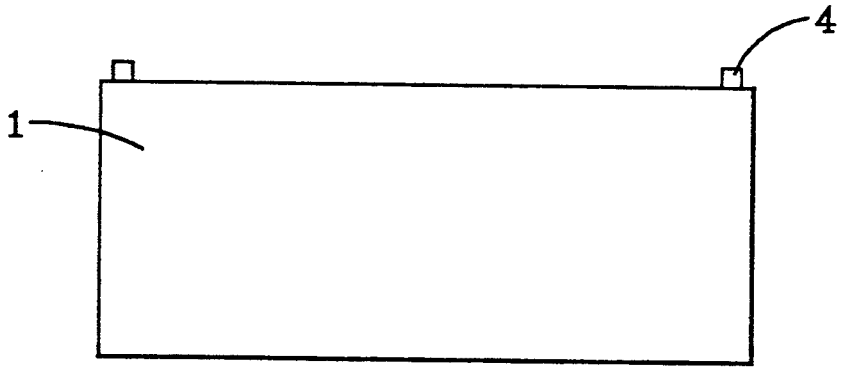
FIG. 4 is a side elevation of the exterior of the spool valve showing its relative size.
Figure 5:
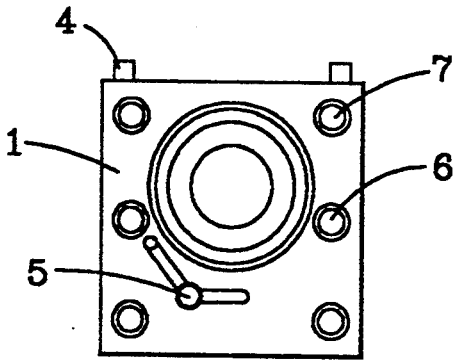

Referring to FIGS. 3 and 5, it may be appreciated by one skilled in the art that access to the valve spool bore 11 for purposes of manufacture and machining of the valve spool bore 11, as well as assembly of the valve spool, might be conveniently addressed through a spool bore 12. It may be further appreciated by one skilled in the art that the standard ISO plug 10 would occupy a substantial portion of the available area by virtue of the required connector passageway 15. The passageway 15 is necessary to contain the ISO plug and permit its connection therethrough the valve body. It may also now be appreciated that the required area for the ISO plug would interfere with the area requirements for the valve spool bore and passageways necessary to communicate with the solenoid valve assembly 20.

It is necessary to accommodate both area requirements while maintaining a pressurized seal between the valve spool bore 11 and the connector passageway. The area requirements vary with time. During manufacture and assembly, access is required. Thereafter in operation, reduced area is required for the cross flow of the pressure fluid which operates the valve spool.

Figure 8:
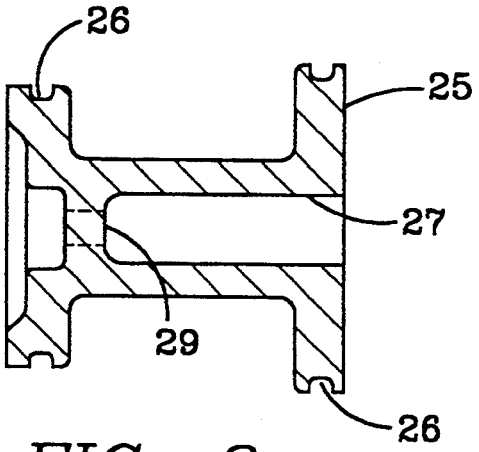
FIG. 8 is a cross section view of the cylindrical transition spool according to the present invention.
Figure 9:
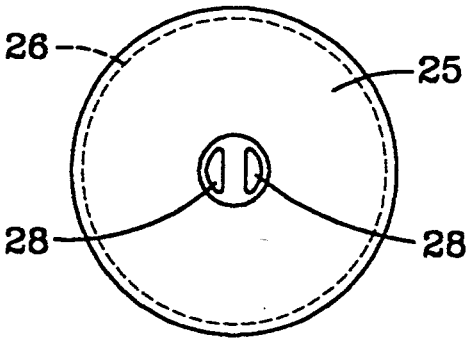
FIG. 9 is an end view of the transition spool.

In order to accomplish the transition of area requirements according to the present invention, a spool bore 12, best seen in FIG. 3, is provided interconnecting the solenoid end of the valve body with the valve spool bore. The spool bore 12 diameter is selected to conveniently manufacture the valve spool bore 11 and assemble the valve spool within the bore 11 during manufacture and initial assembly of the valve. Thereafter, a transition spool 25, best seen in FIGS. 7, 8, and 9, is inserted in the spool bore 12 according to the present invention.

The transition spool 25 is provided with a radial seal 26, on each end, which cooperates with the spool bore 12 at each end to seal the valve spool bore area from the conductor passageway 15. The transition spool 25 is provided with a pneumatic actuation passageway 27 through its spool center. Pressure fluid is transmitted through the center of the transition spool through ports 28, best seen in FIG. 9. The transition spool is provided with a reduced diameter wind area 29. The reduced wind area 29 permits insertion of the ISO plug which would not otherwise be possible in the space constraints of the ISO size 1E valve (see FIG. 7).

The end cap 21 permits the transfer of pressure fluid to the solenoid valve through port 5 and the pressure fluid is in turn selectively applied to the center of the transition spool through port 31 and thereafter to the spool valve via ports 28 in the transition spool 25.

What is claimed is:

1. A means for conveying pressure fluid across a continuing passageway devoid of said pressure fluid in a pressure fluid device while minimizing interruption of said passageway comprising:

an access cross bore of convenient diameter substantially perpendicular to and through said passageway;

a spool means in the form of a sewing thread spool having a cylindrical wind area of minimum required diameter and larger end diameter for insertion in said cross bore from one bored end;

said spool means being provided with sealing means on the outside circumference at each large diameter end of said spool means for sealing cooperation with said access cross bore;

said spool means being further provided with an end to end through bore of selected minimum diameter for conveying said pressure fluid through said bored space; and said spool means being further provided with a thread wind area diameter less than said access cross bore diameter, but greater than said selected minimum diameter for conveying said pressure fluid thereby forming a pressure fluid conduit of minimum diameter through said access cross bore while minimizing the interruption of said passageway.

2. A means for conveying pressure fluid through a continuing passageway in a pressure fluid device while minimizing interruption of said passageway according to claim 1, wherein said access cross bore permits assembly of an operating valve member therethrough.

3. A means for conveying pressure fluid through a continuing passageway in a pressure fluid device while minimizing interruption of said passageway according to claim 1, wherein said sealing means comprises a circumferential "O"ring seal on each of said large diameter ends of said spool.

4. A means for conveying pressure fluid across a continuing passageway in a pressure fluid device while minimizing interruption of said passageway according to claim 1, wherein said passageway comprises a conduit for an electrical connector to pass through said passageway in a stacked pneumatic valve.

* * * * *